US007094996B2

(12) United States Patent
Boehm

(10) Patent No.: US 7,094,996 B2
(45) Date of Patent: Aug. 22, 2006

(54) METHOD FOR CONTROLLING THE TEMPERATURE OF A BAKING OVEN HAVING A CATALYST

(75) Inventor: Karl-Heinz Boehm, Wadersloh (DE)

(73) Assignee: Miele & Cie KG, Guetersloh (DE)

( * ) Notice: Subject to any disclaimer, the term of this patent is extended or adjusted under 35 U.S.C. 154(b) by 27 days.

(21) Appl. No.: 10/817,178

(22) Filed: Apr. 2, 2004

(65) Prior Publication Data

US 2005/0236394 A1 Oct. 27, 2005

(51) Int. Cl.
*H05B 1/02* (2006.01)

(52) U.S. Cl. ..... 219/494; 219/497

(58) Field of Classification Search ..... 219/482, 219/490, 492, 494, 509, 510, 400, 413, 391, 219/393, 399, 497
See application file for complete search history.

(56) References Cited

U.S. PATENT DOCUMENTS 4,292,501 A * 9/1981 Maitenaz ..... 219/413
4,481,404 A * 11/1984 Thomas et al. ..... 219/393
6,232,584 B1 * 5/2001 Meyer ..... 219/497

FOREIGN PATENT DOCUMENTS

| | | |
|---|---|---|
| DE | 19606571 | 8/1997 |
| DE | 19706186 | 8/1998 |
| DE | 10246498 A1 * | 4/2004 |
| EP | 0878667 | 11/1998 |

* cited by examiner

*Primary Examiner*—Tu Hoang
(74) *Attorney, Agent, or Firm*—Darby & Darby

(57) ABSTRACT

A method for controlling the temperature of a baking oven having a catalyst, a heating source, an oven chamber temperature sensor, and a catalyst temperature sensor, includes generating an electrical control signal based on a control state, the control state being a function of signals from the electrical sensors and being reached when the catalyst temperature is higher than the oven chamber temperature and the temperature difference between the catalyst temperature and the oven chamber temperature is greater than or equal to a threshold value. The heating source is controlled using the electrical control signal so that the oven chamber temperature is maintained substantially constant.

21 Claims, 3 Drawing Sheets

METHOD FOR CONTROLLING THE TEMPERATURE OF A BAKING OVEN HAVING A CATALYST

The present invention relates to a method for controlling the temperature of a baking oven containing a catalyst and having a control unit, an oven chamber temperature sensor, and a catalyst temperature sensor; the electrical sensor signals of the oven chamber temperature sensor and the catalyst temperature sensor being processed in an evaluation circuit of the control unit.

BACKGROUND

A method for controlling the temperature of a baking oven containing a catalyst is known, for example, from German Patent DE 197 06 186. In this method, the oven chamber temperature and the catalyst temperature can be controlled separately because the catalyst has a separate catalyst heater. Temperature-time profiles, or threshold values, which are dependent on the selected operating mode, for example, the pyrolytic mode, are stored in the control unit for the oven chamber temperature and the catalyst temperature. If the pyrolysis temperature is not reached within a predetermined time, then the oven chamber heater is turned off for safety reasons. If threshold values for the catalyst temperature, which are also predefined, should be exceeded during pyrolysis, then the oven chamber heater, or the catalyst heater, is turned off as well.

Furthermore, German Patent Application DE 196 06 571 A1 describes a temperature control method in which a pyrolytic cleaning process is controlled as a function of the oven chamber temperature and of a soil sensor that detects the catalyst temperature. In this method, in a first phase of the cleaning process, the oven chamber is heated to about 300° C. only as a function of the oven chamber temperature. In a subsequent second phase of the cleaning process, the oven chamber is then further heated to a maximum temperature required for the pyrolytic cleaning process only as a function of the catalyst temperature.

Moreover, U.S. Pat. No. 4,292,501 describes a temperature control method in which during a pyrolytic cleaning process, the oven chamber is heated only as a function of the catalyst temperature. Once the catalyst temperature exceeds a predefined value, the oven chamber heater is turned off, stopping the pyrolytic cleaning process.

Another temperature control method is known from U.S. Pat. No. 6,232,584 B1. In this method, the pyrolysis time is controlled as a function of the oven chamber temperature and the catalyst temperature. Once the catalyst temperature, after it has first exceeded the oven chamber temperature, falls below this temperature, the pyrolytic cleaning process is terminated after a predetermined period of time has elapsed.

Furthermore, European Patent Application EP 0 878 667 A2 describes a method in which the pyrolytic cleaning process is terminated when the temperature difference between the catalyst temperature and the oven chamber temperature falls below a predefined value.

SUMMARY OF THE INVENTION

It is therefore an object of the present invention to provide a simple method for controlling the temperature of a baking oven containing a catalyst, in which method unwanted coating of the catalyst surface with unconverted vapor components is reduced even when the oven chamber is heavily soiled.

The present invention provides a method for controlling the temperature of a baking oven including a catalyst, a heating source, an oven chamber temperature sensor, and a catalyst temperature sensor. The method includes:

generating a first electrical control signal based on a first control state, the first control state being a function of respective electrical sensor signals from the oven chamber temperature sensor and the catalyst temperature sensor, the first control state being reached when a catalyst temperature is higher than an oven chamber temperature and a temperature difference between the catalyst temperature and the oven chamber temperature is greater than or equal to a first threshold value; and controlling the heating source using the first electrical control signal so that the oven chamber temperature is maintained substantially constant.

In addition to a simple method for controlling the temperature of a baking oven containing a catalyst, a particular advantage that can be achieved with the present invention is a system for implementing the method that is simple in design and therefore inexpensive.

In an advantageous refinement, it is proposed to generate a second electrical control signal based on a second control state; the second control state being reached when the catalyst temperature is higher than the oven chamber temperature, and the temperature difference between the catalyst temperature and the oven chamber temperature is initially greater than the first threshold value and, at a later time, is smaller than a second threshold value. Thus, the inertia of the system to be controlled can be compensated for in the control.

The influence of the second electrical control signal on the heating source can, in principle, be selected within wide suitable limits. Advantageously, the second electrical control signal acts on the heating source in such a manner that the oven chamber temperature is increased or maintained substantially constant at a first predefined value for a first predetermined period of time.

In a particular advantageous refinement of the teaching of the present invention, it is proposed to generate a third electrical control signal based on a third control state; the third control state being reached when the catalyst temperature is higher than the oven chamber temperature and the temperature difference between the catalyst temperature and the oven chamber temperature is greater than or equal to a third threshold value. In this manner, the control system according to the present invention is further refined so that the oven chamber temperature follows a predetermined pattern even better in its profile over time.

An advantageous further development of the aforementioned embodiment proposes that the third electrical control signal act on the heating source in such a manner that the oven chamber temperature falls to or below a fourth threshold value. This allows quick control so that the desired temperatures can be reached with little delay.

In a further advantageous refinement, it is proposed to generate a fourth electrical control signal based on a fourth control state; the fourth control state being reached when the catalyst temperature is higher than the oven chamber temperature, the temperature difference between the catalyst temperature and the oven chamber temperature is initially greater than or equal to the third threshold value, and, at a later time, the oven chamber temperature is at the fourth threshold value. This further improves the compensation of the inertia of the system to be controlled.

A particularly advantageous refinement of the aforementioned embodiment proposes that the fourth electrical control signal act on the heating source in such a manner that the oven chamber temperature is maintained substantially constant at the fourth threshold value. This allows transient response of the control system in spite of improved inertia compensation.

In an advantageous refinement of the teaching according to the present invention, it is proposed that the first and/or the third electrical control signal(s) act on the heating source in such a manner that the oven chamber temperature is maintained substantially constant at a second predefined value for at least a second predetermined period of time. Thus, for example, in the pyrolytic mode, it is possible to adapt the pyrolysis time to the soil level of the baking oven.

BRIEF DESCRIPTION OF THE DRAWINGS

An exemplary embodiment of the present invention is shown in the drawings in a purely schematic way and will be described in more detail below.

DETAILED DESCRIPTION

Figure 1:
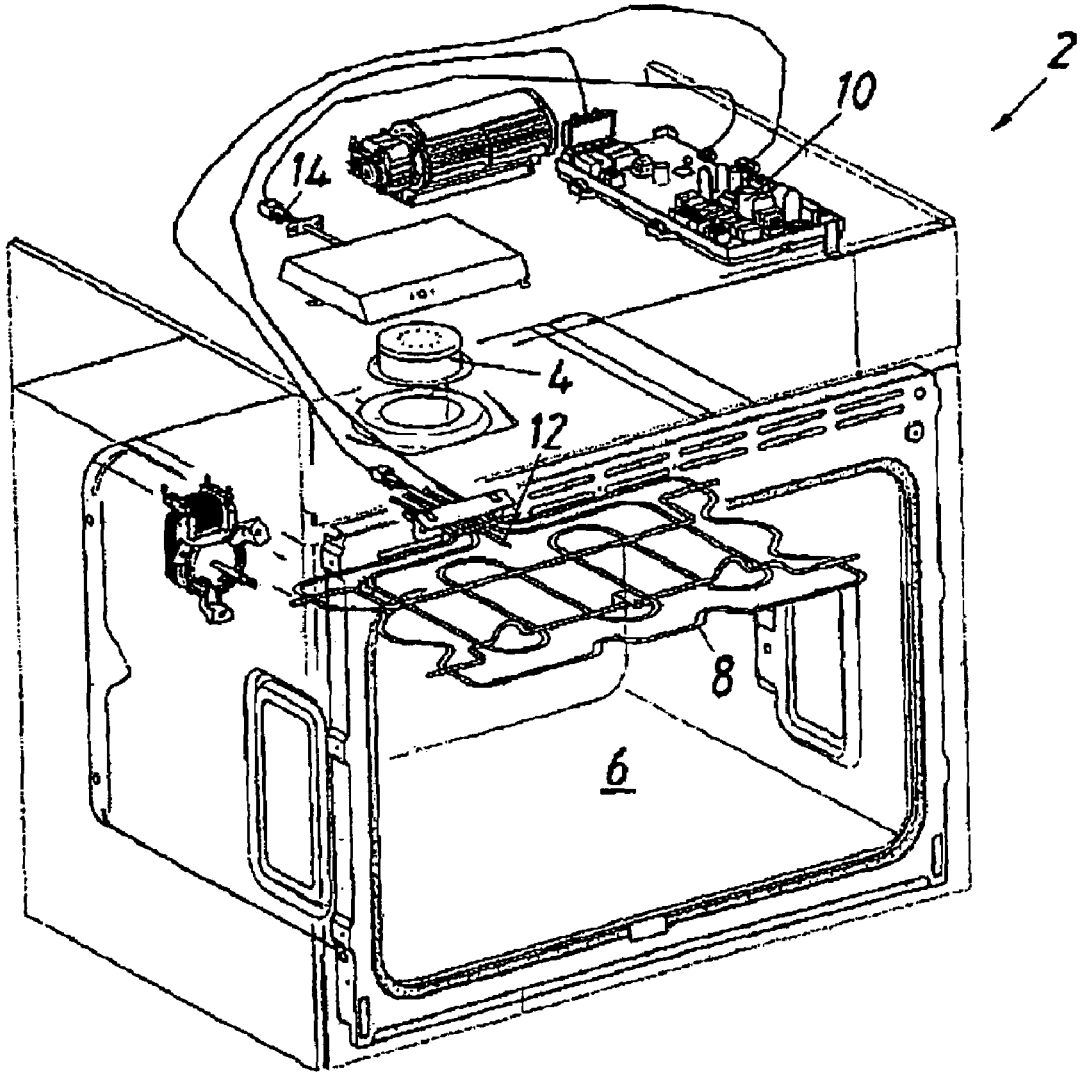
FIG. 1 is a partial perspective view of a system for implementing the method according to the present invention.

In FIG. 1, system for implementing the method according to the present invention is shown by way of example. This system is system is a baking oven (2) containing a catalyst (4) located in the exhaust path for the vapors. To heat oven chamber (6) of baking oven (2), a heating source (8) in the form of an electric radiant heating element is disposed in oven chamber (6). The heating power of heating source (8) is controllable via a control unit (10). For this purpose, an oven chamber temperature sensor (12) in the form of an electrical resistance temperature sensor is disposed in oven chamber (6), and a catalyst temperature sensor (14), which also takes the form of an electrical resistance temperature sensor, is arranged downstream of catalyst (4) in the direction of flow. Oven chamber temperature sensor (12), catalyst temperature sensor (14), and heating source (8) are electrically conductively connected to control unit (10), allowing electrical signals to be exchanged between temperature sensors (12, 14) and control unit (10). Moreover, heating source (8) is supplied with an electrical heating current as a function of an electrical signal of control unit (10). In this exemplary embodiment, control unit (10) has a microprocessor and a memory (not shown). In the memory, data is stored for the different operating modes of the baking oven, such as the pyrolytic mode. The electrical sensor signals of oven chamber temperature sensor (12) and catalyst temperature sensor (14) are processed in an evaluation circuit (also not shown) of control unit (10) in such a manner that when a control state which is dependent on the electrical sensor signals is reached, control unit (10) generates at least one electrical control signal that influences heating source (8) in a predetermined manner. For example, during the pyrolytic cycle, control unit (10) compares the current electrical sensor signals to the data stored in the memory. In control unit (10) of this exemplary embodiment of the present invention, the current temperature difference between the oven chamber temperature and the catalyst temperature is compared to the stored data. If correspondence is established, a control state is reached which in turn produces an electrical control signal that influences the heating current supply to heating source (8). A resulting change in the heating power of heating source (8), in turn, results in a change in the temperature difference between the oven chamber temperature and the catalyst temperature.

Moreover, the processing in the evaluation circuit of the control unit depends on whether the catalyst temperature is higher or lower than the oven chamber temperature.

Figure 2:
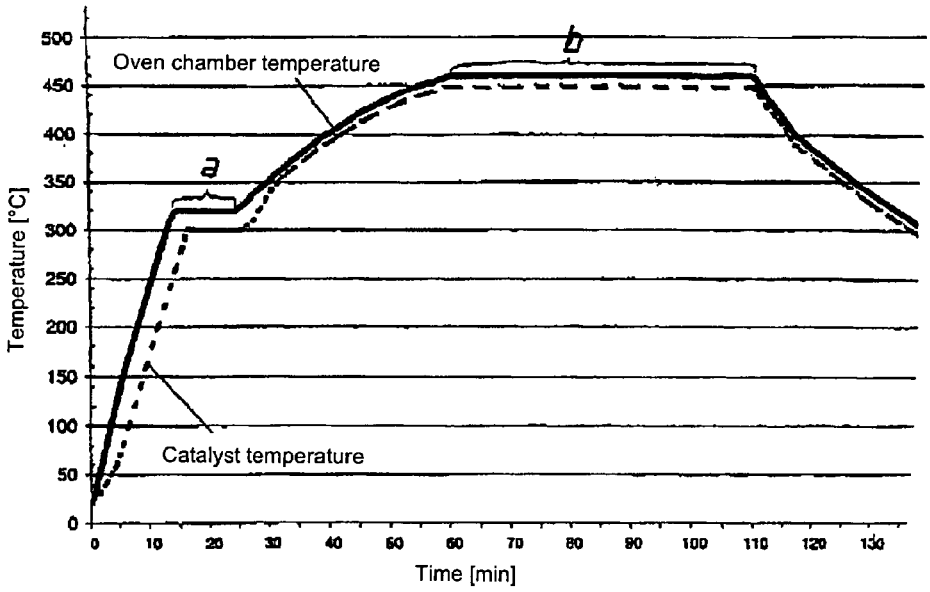
FIG. 2 is a temperature-time diagram of a first exemplary sequence of the method according to the present invention.

The above exemplary embodiment of the method according to the present invention will be explained below with reference to FIGS. 2 through 4:

In FIG. 2, the profiles of the oven chamber temperature and the catalyst temperature during the pyrolytic cycle are exemplarily shown in a temperature-time diagram for the case that the oven chamber is only lightly soiled. In the case of light soling of the oven chamber, only a small amount of smoke is produced so that the catalyst performance is not significantly impaired. In the example chosen, the catalyst temperature remains below the oven chamber temperature during the entire time interval shown in the diagram. In this case, initially, the oven chamber temperature is continuously raised to about 320° C. At about 320° C., the oven chamber temperature is maintained substantially constant for about 10 min. After this first holding phase (a), the oven chamber temperature is further increased. At about 460° C., the oven chamber temperature is maintained substantially constant for about 50 min. After this second holding phase (b), the oven chamber temperature is continuously decreased. As can be inferred from FIG. 2, the catalyst temperature follows the profile of the oven chamber temperature over time.

Figure 3:
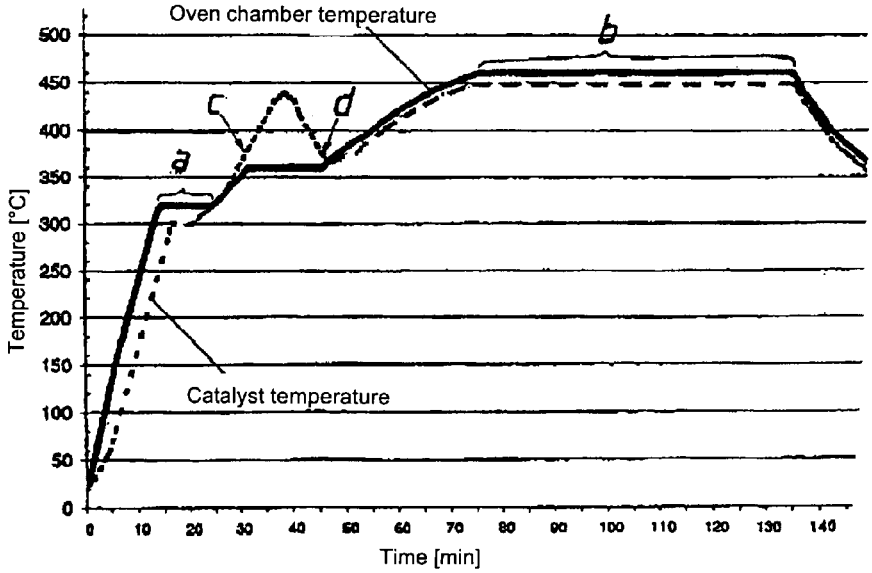
FIG. 3 is a temperature-time diagram of a second exemplary sequence of the method according to the present invention.

In FIG. 3, the profiles of the oven chamber temperature and the catalyst temperature during the pyrolytic cycle are exemplarily shown in a temperature-time diagram for the case that the oven chamber is soiled to a medium degree. If in this case the procedure were analogous to the case of an oven chamber with only a light soil level, which has been explained, by way of example, with reference to FIG. 2, then catalyst (8) would not be able to completely convert the smoke produced by the soil of the oven chamber. The reactive surface of catalyst (8) would become coated with the unconverted vapor components, decreasing the performance of the catalyst. In the case of a medium soil level of the oven chamber, the catalyst performance would therefore be impaired. In order to prevent this, the exemplary embodiment includes the following steps: A first electrical control signal is generated based on a first control state; the first control state being reached when the catalyst temperature is higher than the oven chamber temperature, and the temperature difference between the catalyst temperature and the oven chamber temperature is greater than a first threshold value (c) of 20 K. A second electrical control signal is generated based on a second control state; the second control state being reached when the catalyst temperature is higher than the oven chamber temperature, and the temperature difference between the catalyst temperature and the oven chamber temperature is initially greater than the first threshold value (c) of 20 K, and, at a later time, is smaller than a second threshold value (d) of 15 K. The two method steps will be explained below with reference to FIG. 3:

Analogously to the first case, the oven chamber temperature is continuously raised to about 320° C. in the pyrolytic mode, and this oven chamber temperature is maintained for about 10 min. At the end of this first holding phase (a), heating is continued. During this heating, the catalyst temperature increases faster than the oven chamber temperature, and the temperature difference between the catalyst temperature and the oven chamber temperature exceeds the first threshold value (c) of 20 K. The first control state is reached, and the first electrical control signal is generated. Based on this control signal, the electrical heating current to heating source (8) is maintained approximately constant so that the heating power, and thus the oven chamber temperature, are maintained substantially constant (see FIG. 3). As can also be inferred from FIG. 3, the oven chamber temperature is maintained constant until the second control state is reached, i.e., until the temperature difference between the catalyst temperature and the oven chamber temperature has fallen to the second threshold value (d) of 15 K. When the second control state is reached, the second electrical control signal is generated. Based on this control signal, the electrical heating current to heating source (8) is further increased so that the oven chamber temperature increases again. In the case that the first control state is reached during the first holding phase (a), the second electrical control signal initially causes a further 10-minute holding phase (not shown) and, at a later time, causes the oven chamber temperature to further increase. The subsequent profiles of the catalyst temperature and the oven chamber temperature are similar to the first case; however, in addition to the effect mentioned above, the first electrical control signal lengthens the duration of second holding phase (b) by about 10 min. to a total of 60 min.

Figure 4:
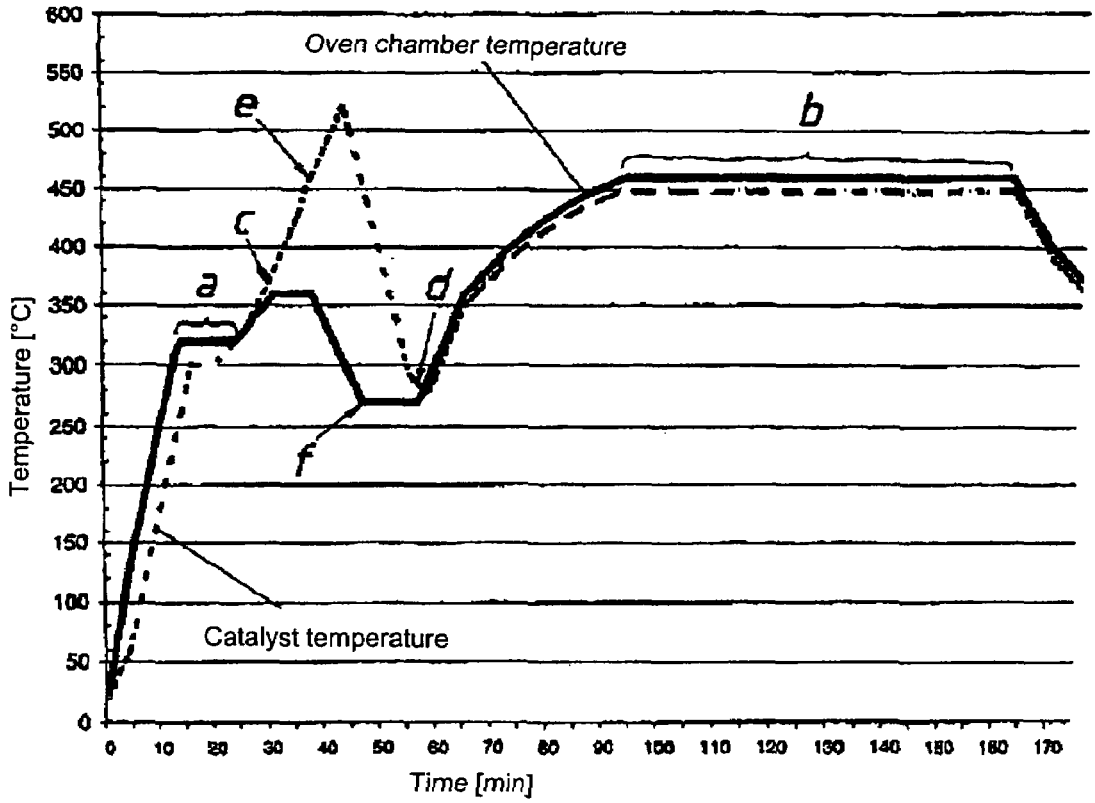
FIG. 4 is a temperature-time diagram of a third exemplary sequence of the method according to the present invention.

In FIG. 4, the profiles of the oven chamber temperature and the catalyst temperature during the pyrolytic cycle are exemplarily shown in a temperature-time diagram for the case that the oven chamber is heavily soiled. In comparison with the aforementioned example case, the catalyst would convert even less smoke, and the catalyst performance would be impaired to an even greater extent. In order to prevent this, the exemplary embodiment includes the following steps: A third electrical control signal is generated based on a third control state; the third control state being reached when the catalyst temperature is higher than the oven chamber temperature, and the temperature difference between the catalyst temperature and the oven chamber temperature is greater than or equal to a third threshold value (e) of 100 K. A fourth electrical control signal is generated based on a fourth control state; the fourth control state being reached when the catalyst temperature is higher than the oven chamber temperature, the temperature difference between the catalyst temperature and the oven chamber temperature is initially greater than the third threshold value (e) of 100 K, and, at a later time, the oven chamber temperature is at the fourth threshold value (f) of 270° C. The two method steps will be explained below with reference to FIG. 4:

Analogously to the two preceding example cases of FIGS. 2 and 3, the oven chamber is initially heated to 320° C., and this oven chamber temperature is maintained substantially constant during first holding phase (a) of about 10 minutes. As the oven chamber is further heated, the catalyst temperature exceeds the oven chamber temperature by more than 20 K, first threshold value (c) is exceeded, and the first electrical control signal, which has already been explained with reference to FIG. 3, is generated so that the oven chamber temperature is maintained constant at its current value of about 360° C. However, due to the heavy soil level of the oven chamber, this measure is not sufficient to prevent the production of smoke, or to reduce it to a level that can be converted by the catalyst, so that the catalyst temperature is further increased, and the temperature difference between the catalyst temperature and the oven chamber temperature reaches the third threshold value (e) of about 100 K. The third electrical control signal is generated, whereupon heating source (8) is turned off. The oven chamber temperature and the catalyst temperature decrease. Once the oven chamber temperature has dropped to the fourth threshold value (f) of 270° C., the fourth control state is reached, and the fourth electrical control signal is generated. The fourth electrical control signal causes the oven chamber temperature to be maintained substantially constant at about 270° C. as the catalyst temperature decreases further. Once the temperature difference between the catalyst temperature and the oven chamber temperature has decreased to the second threshold (d) of 15 K, then, as already explained above, the second electrical control signal is generated so that the oven chamber is heated further. The subsequent profiles of the catalyst temperature and the oven chamber temperature are similar to the two aforementioned example cases; however, the third electrical control signal further causes the duration of the second holding phase (b) at about 460° C. to be lengthened by an additional 10 minutes to a total of then 70 minutes.

What is claimed is:

1. A method for controlling the temperature of a baking oven including a catalyst, a heating source, an oven chamber temperature sensor, and a catalyst temperature sensor, the method comprising:

generating a first electrical control signal based on a first control state, the first control state being a function of respective electrical sensor signals from the oven chamber temperature sensor and the catalyst temperature sensor, the first control state being reached when a catalyst temperature is higher than an oven chamber temperature and a temperature difference between the catalyst temperature and the oven chamber temperature is increasing and exceeds a first threshold value; and controlling the heating source using the first electrical control signal so that the oven chamber temperature is maintained substantially constant.

2. The method as recited in claim 1 wherein the heating source includes an electrical heating element of the baking oven.

3. The method as recited in claim 1 further comprising generating a second electrical control signal based on a second control state, the second control state being a function of the electrical sensor signals and being reached when the catalyst temperature is higher than the oven chamber temperature, and the temperature difference between the catalyst temperature and the oven chamber temperature is smaller than a second threshold value and was previously greater than the first threshold value.

4. The method as recited in claim 3 further comprising controlling the heating source using the second electrical control signal so that the oven chamber temperature is increased or maintained substantially constant at a first predefined value for a first predetermined period of time.

5. The method as recited in claim 1 further comprising generating a third electrical control signal based on a third control state, the third control state being a function of the electrical sensor signals and being reached when the catalyst temperature is higher than the oven chamber temperature and the temperature difference between the catalyst temperature and the oven chamber temperature is greater than or equal to a third threshold value.

6. The method as recited in claim 5 further comprising controlling the heating source using the third electrical control signal so that the oven chamber temperature falls to or below a fourth threshold value.

7. The method as recited in claim 6 further comprising generating a fourth electrical control signal based on a fourth control state, the fourth control state being a function of the electrical sensor signals and being reached when the catalyst temperature is higher than the oven chamber temperature, the oven chamber temperature is at the fourth threshold value, and the temperature difference between the catalyst temperature and the oven chamber temperature was previously greater than or equal to the third threshold value.

8. The method as recited in claim 7 further comprising controlling the heating source using the fourth electrical control signal so that the oven chamber temperature is maintained substantially constant at the fourth threshold value.

9. The method as recited in claim 1 further comprising controlling the heating source using the first electrical control signal so that the oven chamber temperature is maintained substantially constant at a second predefined value for at least a second predetermined period of time.

10. The method as recited in claim 5 further comprising controlling the heating source using the third electrical control signal so that the oven chamber temperature is maintained substantially constant at a second predefined value for at least a second predetermined period of time.

11. The method as recited in claim 1 wherein the baking oven includes a control unit having an evaluation circuit configured to process the electrical sensor signals, and wherein the generating is performed by the control unit.

12. A method for controlling the temperature of a baking oven including a catalyst, a heating source, an oven chamber temperature sensor, and a catalyst temperature sensor, the method comprising:

generating a first electrical control signal based on a first control state, the first control state being a function of respective electrical sensor signals from the oven chamber temperature sensor and the catalyst temperature sensor, the first control state being reached when a catalyst temperature is higher than an oven chamber temperature and a temperature difference between the catalyst temperature and the oven chamber temperature is greater than or equal to a first threshold value;

controlling the heating source using the first electrical control signal so that the oven chamber temperature is maintained substantially constant; and generating a second electrical control signal based on a second control state, the second control state being a function of the electrical sensor signals and being reached when the catalyst temperature is higher than the oven chamber temperature, and the temperature difference between the catalyst temperature and the oven chamber temperature is smaller than a second threshold value and was previously greater than the first threshold value.

13. The method as recited in claim 12 wherein the heating source includes an electrical heating element of the baking oven.

14. The method as recited in claim 12 further comprising controlling the heating source using the second electrical control signal so that the oven chamber temperature is increased or maintained substantially constant at a first predefined value for a first predetermined period of time.

15. The method as recited in claim 12 further comprising generating a third electrical control signal based on a third control state, the third control state being a function of the electrical sensor signals and being reached when the catalyst temperature is higher than the oven chamber temperature and the temperature difference between the catalyst temperature and the oven chamber temperature is greater than or equal to a third threshold value.

16. The method as recited in claim 15 further comprising controlling the heating source using the third electrical control signal so that the oven chamber temperature falls to or below a fourth threshold value.

17. The method as recited in claim 16 further comprising generating a fourth electrical control signal based on a fourth control state, the fourth control state being a function of the electrical sensor signals and being reached when the catalyst temperature is higher than the oven chamber temperature, the oven chamber temperature is at the fourth threshold value, and the temperature difference between the catalyst temperature and the oven chamber temperature was previously greater than or equal to the third threshold value.

18. The method as recited in claim 17 further comprising controlling the heating source using the fourth electrical control signal so that the oven chamber temperature is maintained substantially constant at the fourth threshold value.

19. The method as recited in claim 12 further comprising controlling the heating source using the first electrical control signal so that the oven chamber temperature is maintained substantially constant at a second predefined value for at least a second predetermined period of time.

20. The method as recited in claim 15 further comprising controlling the heating source using the third electrical control signal so that the oven chamber temperature is maintained substantially constant at a second predefined value for at least a second predetermined period of time.

21. The method as recited in claim 12 wherein the baking oven includes a control unit having an evaluation circuit configured to process the electrical sensor signals, and wherein the generating is performed by the control unit.

* * * * *